US010565950B2

(12) United States Patent
Zhao

(10) Patent No.: US 10,565,950 B2
(45) Date of Patent: Feb. 18, 2020

(54) LIQUID CRYSTAL DISPLAY PANEL AND COMMON VOLTAGE COMPENSATION METHOD, DEVICE THEREOF

(71) Applicant: Shenzhen China Star Optoelectronics Technology Co., Ltd., Shenzhen, Guangdong (CN)

(72) Inventor: Li Zhao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 182 days.

(21) Appl. No.: 15/545,714

(22) PCT Filed: May 10, 2017

(86) PCT No.: PCT/CN2017/083825

§ 371 (c)(1),
(2) Date: Jul. 23, 2017

(87) PCT Pub. No.: WO2018/201513

PCT Pub. Date: Nov. 8, 2018

(65) Prior Publication Data

US 2019/0101776 A1 Apr. 4, 2019

(30) Foreign Application Priority Data

May 3, 2017 (CN) ..... 2017 1 0305053

(51) Int. Cl.
*G09G 3/36* (2006.01)

(52) U.S. Cl.
CPC ..... *G09G 3/3655* (2013.01); *G09G 3/3677* (2013.01); *G09G 3/3688* (2013.01);
(Continued)

(58) Field of Classification Search
CPC G02F 1/13306; G09G 3/3696; G09G 3/3688; G09G 3/3677; G09G 2320/0209;
(Continued)

(56) References Cited

U.S. PATENT DOCUMENTS

2010/0277399 A1 11/2010 Yu et al.
2011/0102401 A1* 5/2011 Feng ..... G09G 3/3655 345/211

(Continued)

FOREIGN PATENT DOCUMENTS

CN 102054449 A 5/2011
CN 103578439 A 2/2014

(Continued)

*Primary Examiner* — Jonathan A Boyd
(74) *Attorney, Agent, or Firm* — Andrew C. Cheng

(57) ABSTRACT

Disclosed is a liquid crystal display panel, comprising an array substrate and a common voltage compensation circuit. The array substrate comprises scan lines, data lines, common electrode lines and sub pixel units arranged in array. The scan lines provide driving voltages to the sub pixel units, and the data lines provide data voltages to the sub pixel units, and the common electrode lines provide common voltages to the sub pixel units. The common voltage compensation circuit comprises a feedback signal processor, an amplifier and a common voltage adjusting circuit, and the feedback signal processor is connected to the common electrode lines to obtain feedback signals of the common voltages, and the amplifier implements an amplifying process to the feedback signals after inversion to obtain compensation signals, and the common voltage adjusting circuit inputs the compensation signals to the common electrode lines.

8 Claims, 4 Drawing Sheets

(52) U.S. Cl.
CPC ... *G09G 3/3696* (2013.01); *G09G 2300/0447* (2013.01); *G09G 2300/0819* (2013.01); *G09G 2320/0209* (2013.01); *G09G 2320/0257* (2013.01)

(58) Field of Classification Search
CPC ... G09G 2320/0257; G09G 2300/0819; G09G 3/3655; G09G 2300/0447; H01L 27/124
See application file for complete search history.

(56) References Cited

U.S. PATENT DOCUMENTS

2013/0314393 A1* 11/2013 Min ..... G09G 3/36
345/212
2017/0061917 A1* 3/2017 Chen ..... G09G 3/3688

FOREIGN PATENT DOCUMENTS

CN 103995375 A 8/2014
CN 105093740 A 11/2015

* cited by examiner

LIQUID CRYSTAL DISPLAY PANEL AND COMMON VOLTAGE COMPENSATION METHOD, DEVICE THEREOF

CROSS REFERENCE

This application claims the priority of Chinese Patent Application No. 201710305053.8, entitled "Liquid crystal display panel and common voltage compensation method, device thereof", filed on May 3, 2017, the disclosure of which is incorporated herein by reference in its entirety.

FIELD OF THE INVENTION

The present invention relates to a display technology field, and more particularly to a liquid crystal display panel and a common voltage compensation method, a device thereof.

BACKGROUND OF THE INVENTION

The Liquid Crystal Display (LCD) is one of the most widely used flat panel displays. The LCD comprises a pair of panels provided with field-generating electrodes, such as a pixel electrode and a common electrode, and a liquid crystal (LC) layer disposed between the two panels. When the voltages are applied to the field-generating electrodes to generate an electric field in the LC layer, the electric field determines the orientations of the LC molecules in the liquid crystal layer so as to adjust the polarization of the light incident into the LC layer to cause the LCD to display images. In order to improve the color shift problem of large viewing angle LCD, the pixels in the liquid crystal display panel can be changed from 4 domains structure to 8 domains structure. In the 8 domains structure, one sub pixel unit is divided into a main pixel region and a sub pixel region. By adding one Thin Film Transistor (TFT) in the sub pixel region to release a portion of charges on the liquid crystal capacitor in the sub pixel region to the common electrode of the storage capacitor, the pixel voltages and the display brightnesses in the main pixel region and the sub pixel region can be different to achieve the effect of improving the color shift. However, this causes the voltages on the common electrodes of the storage capacitors to be unstable and is easily to receiving the coupling of other signals, thereby causing defects, such as crosstalk, image sticking and etc.

SUMMARY OF THE INVENTION

The embodiment of the present invention provides a liquid crystal display panel and a common voltage compensation method, a device thereof to promote the stability of common voltages and to reduce the risks of crosstalk and image sticking for improving the quality of the liquid crystal display panel.

Disclosed is a liquid crystal display panel, comprising: an array substrate and a common voltage compensation circuit, wherein the array substrate comprises a plurality of scan lines, which are separately arranged in parallel along a horizontal direction, a plurality of data lines, which are separately arranged in parallel along a vertical direction, a plurality of common electrode lines and a plurality of sub pixel units arranged in array, and the scan lines provide driving voltages to the sub pixel units, and the data lines provide data voltages to the sub pixel units, and the common electrode lines provide common voltages to the sub pixel units, and the common voltage compensation circuit comprises a feedback signal processor, an amplifier and a common voltage adjusting circuit, and the feedback signal processor is connected to the common electrode lines to obtain feedback signals of the common voltages and to implement an inversion process to the feedback signals, and the amplifier is connected between the feedback signal processor and the common voltage adjusting circuit to implement an amplifying process to the feedback signals after inversion to obtain compensation signals, and the common voltage adjusting circuit inputs the compensation signals to the common electrode lines.

The liquid crystal display panel further comprises a driving circuit board, and the driving circuit board is configured at one side of the array substrate and electrically connected to the array substrate via a first signal port and a second signal port, and the common voltage compensation circuit is configured on the driving circuit board to obtain the feedback signals of the common voltages via the first signal port and to provide the compensation signals to the common electrode lines via the second signal port.

The plurality of common electrode lines are arranged alternately in parallel with the plurality of scan lines, and are collectively connected to an output end of the common voltage adjusting circuit via the second signal port to obtain the common voltages from the common voltage adjusting circuit.

The array substrate further comprises a first feedback connection point, and the first feedback connection point is configured at one end of a common electrode line located at a middle position of the array substrate, and the feedback signal processor is connected to the first feedback connection point via the first signal port to obtain the feedback signals of the common voltages from the first feedback connection point.

The array substrate further comprises a second feedback connection point, and the second feedback connection point is configured at one end of a common electrode line located at one side of the array substrate opposite to the driving circuit board, and the feedback signal processor is connected to the second feedback connection point via the first signal port to obtain the feedback signals of the common voltages from the second feedback connection point.

One of the sub pixel units comprises a main pixel region and a sub pixel region, and the main pixel region and the sub pixel region each comprise a driving transistor, a storage capacitor and a liquid crystal capacitor, and the sub pixel region further comprises a discharge transistor to partially release charge on the liquid crystal capacitor of the sub pixel region to one of the common electrode lines.

The driving transistor, the storage capacitor and the liquid crystal capacitor of the main pixel region are a first transistor, a first storage capacitor and a first liquid crystal capacitor, and a gate of the first transistor is connected to one of the scan lines, and a drain of the first transistor is connected to one of the data lines, and a source of the first transistor is connected to one end of the first storage capacitor and one end of the first liquid crystal capacitor, and the other end of the first storage capacitor is connected to one of the common electrode lines, and the other end of the first liquid crystal capacitor is connected to a common electrode.

The driving transistor, the storage capacitor and the liquid crystal capacitor of the sub pixel region are a second transistor, a second storage capacitor and a second liquid crystal capacitor, and the sub pixel region further comprises a third resistor, and a gate of the second transistor is connected to one of the scan lines, and a drain of the second transistor is connected to one of the data lines, and a source of the second transistor is connected to one end of the second storage capacitor and one end of the second liquid crystal capacitor, and the other end of the second storage capacitor is connected to one of the common electrode lines, and the other end of the second liquid crystal capacitor is connected to a common electrode, and a gate of the third transistor is connected to the one of the scan lines, and a drain of the third transistor is connected to the source of the second transistor, and a source of the third transistor is connected to the one of the common electrode lines.

Disclosed is a common voltage compensation method of a liquid crystal display panel, comprising steps of:

obtain feedback signals of common voltages on common electrode lines of the liquid crystal display panel;

implement an inversion process and an amplifying process to the feedback signals to obtain corresponding compensation signals;

inputting the compensation signals to the common electrode lines to implement compensation to the common voltages with the compensation signals.

Disclosed is a common voltage compensation device of a liquid crystal display panel, comprising:

a voltage obtaining unit, obtaining feedback signals of common voltages on common electrode lines of the liquid crystal display panel;

an inversion processing unit, implementing an inversion process and an amplifying process to the feedback signals to obtain corresponding compensation signals;

a voltage compensation unit, inputting the compensation signals to the common electrode lines to implement compensation to the common voltages with the compensation signals.

By configuring the common voltage compensation circuit, the liquid crystal display panel obtains the feedback signals of the common voltages on the common voltage lines and implements the inversion process and the amplifying process to the feedback signals to obtain the corresponding compensation signals, and then to input the compensation signals to the common electrode lines for realizing the compensation to the common voltages, which can effectively promote the stability of the common voltages and prevent the issues of crosstalk and image sticking of the liquid crystal display panel due to fluctuations in the common voltages to improve the quality of the liquid crystal display panel.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Spatially relative terms, such as "below", "beneath", "lower", "above", "upper" and the like, may be used herein for ease of description to describe one element or feature's relationship to another element(s) or feature as illustrated in the figures. It will be understood that when an element or layer is referred to as being "on", "connected to" or "coupled to" another element or layer, it can be directly on the other element or layer or intervening elements or layers may be present. In contrast, when an element is referred to as being "directly on", "directly connected to" or "directly coupled to" another element or layer, there are no intervening elements or layers present.

It is understandable that the terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Figure 1:
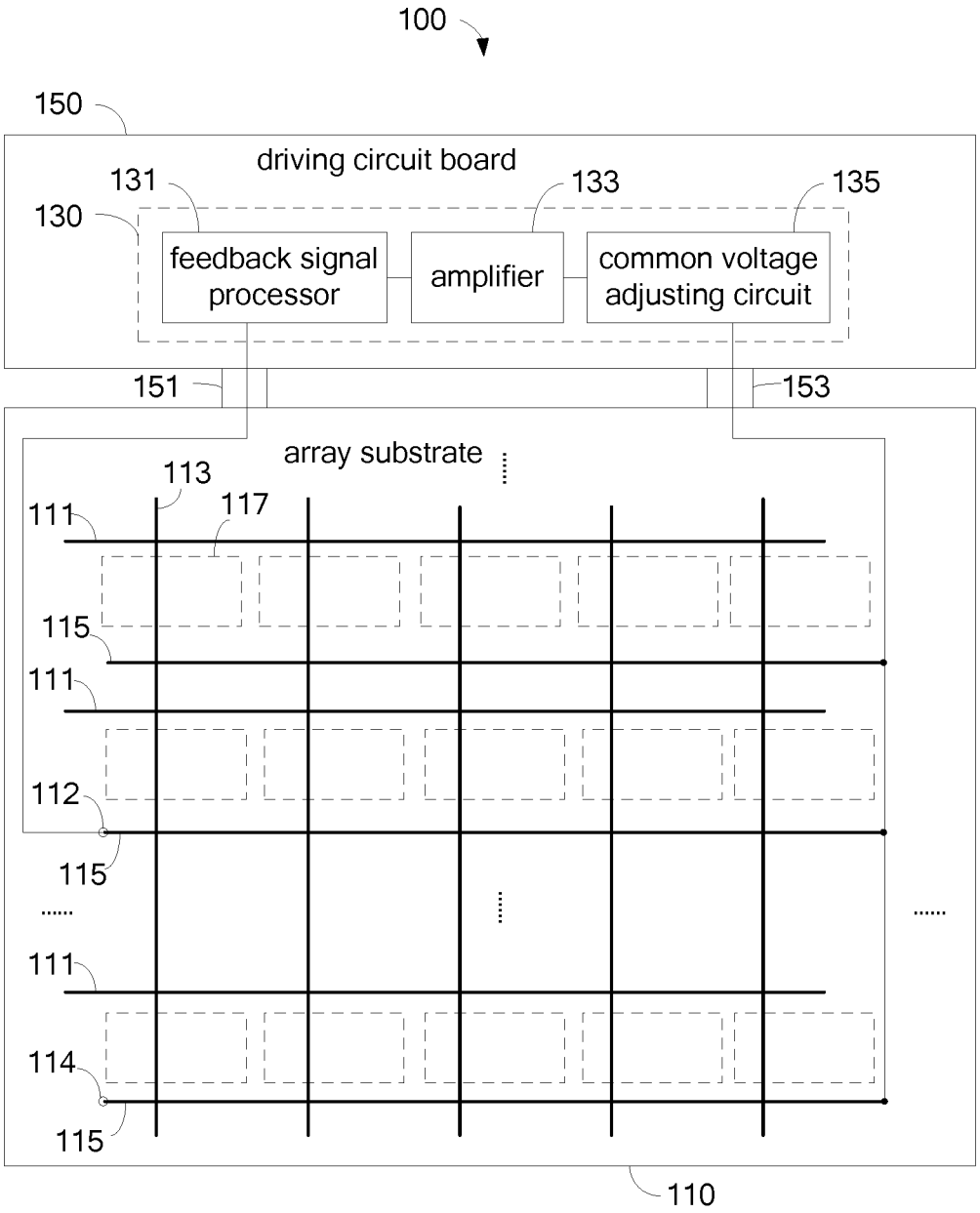
FIG. 1 is a structure diagram of a liquid crystal display panel provided by the embodiment of the present invention.

Please refer to FIG. 1. In one embodiment of the present invention, provided is a liquid crystal display panel 100, comprising: an array substrate 110 and a common voltage compensation circuit 130, wherein the array substrate 110 comprises a plurality of scan lines 111, which are separately arranged in parallel along a horizontal direction, a plurality of data lines 113, which are separately arranged in parallel along a vertical direction, a plurality of common electrode lines 115 and a plurality of sub pixel units 117 arranged in array, and the scan lines 111 provide driving voltages to the sub pixel units 117, and the data lines 113 provide data voltages to the sub pixel units 117, and the common electrode lines 115 provide common voltages to the sub pixel units 117, and the common voltage compensation circuit 130 comprises a feedback signal processor 131, an amplifier 133 and a common voltage adjusting circuit 135, and the feedback signal processor 131 is connected to the common electrode lines 115 to obtain feedback signals of the common voltages and to implement an inversion process to the feedback signals, and the amplifier 133 is connected between the feedback signal processor 131 and the common voltage adjusting circuit 135 to implement an amplifying process to the feedback signals after inversion to obtain compensation signals, and the common voltage adjusting circuit 135 inputs the compensation signals to the common electrode lines 115 to compensate the common voltages.

In this embodiment, the feedback signal processor 131 may process the feedback signal of the obtained common voltages, such as filtering or inversion process. Since the obtained feedback signal may be affected by factors, such as the coupling of the other signals on the array substrate 110 and the impedance of the signal line during the transmission, the signal obtained after inversion cannot reach the voltage value, which is actually required to be compensated. The amplifier 133 is configured in the post stage circuit of the feedback signal processor 131 to amplify the common voltage after inversion to obtain the compensation signal, which is required. It will be appreciated that the magnification of the amplifier 133 may vary depending on the actual needs.

It will be appreciated that if the common voltages on the common electrode lines 115 fluctuate, the pixel voltage on the sub pixel units 117 are unstable, thereby causing defects such as crosstalk, image sticking and etc. In this embodiment, by obtaining the feedback signals of the common voltages on the common voltage lines 115 and implementing the inversion process and the amplifying process to the feedback signals to obtain the corresponding compensation signals, and then to overlap the compensation signals to the common voltages outputted by the common voltage adjusting circuit 135 for realizing the compensation to the common voltages and effectively promoting the stability of common voltages.

The liquid crystal display panel 100 further comprises a driving circuit board 150, and the driving circuit board 150 is configured at one side of the array substrate 110 and electrically connected to the array substrate 110 via a first signal port 151 and a second signal port 153. The common voltage compensation circuit 130 is configured on the driving circuit board 150 to obtain the feedback signals of the common voltages via the first signal port 151 and to provide the compensation signals to the common electrode lines 115 via the second signal port 153.

It will be appreciated that the plurality of common electrode lines 115 are arranged alternately in parallel with the plurality of scan lines 111, and are collectively connected to an output end of the common voltage adjusting circuit 135 via the second signal port 153 to obtain the common voltages from the common voltage adjusting circuit 135. Since the transmission distances of the common voltages from the common voltage adjusting circuit 135 to the different common electrode lines are different and there is coupling of other signals on the array substrate, it may result in differences among the common voltages on the common electrode lines located at different locations of the array substrate. For instance, the fluctuation amplitude of the common voltage on the common electrode line away from one side of the driving circuit board 150 may be larger than the fluctuation amplitude of the common voltage on the common electrode line close to the one side of the driving circuit board 150. Therefore, the different feedback signal obtaining points can be set to obtain different compensation signals to achieve different compensation effects.

In one embodiment, the array substrate 110 further comprises a first feedback connection point 112, and the first feedback connection point 112 is configured at one end of a common electrode line 115 located at a middle position of the array substrate 110, and the feedback signal processor 131 is connected to the first feedback connection point 112 via the first signal port 151 to obtain the feedback signals of the common voltages from the first feedback connection point 112.

Figure 2:
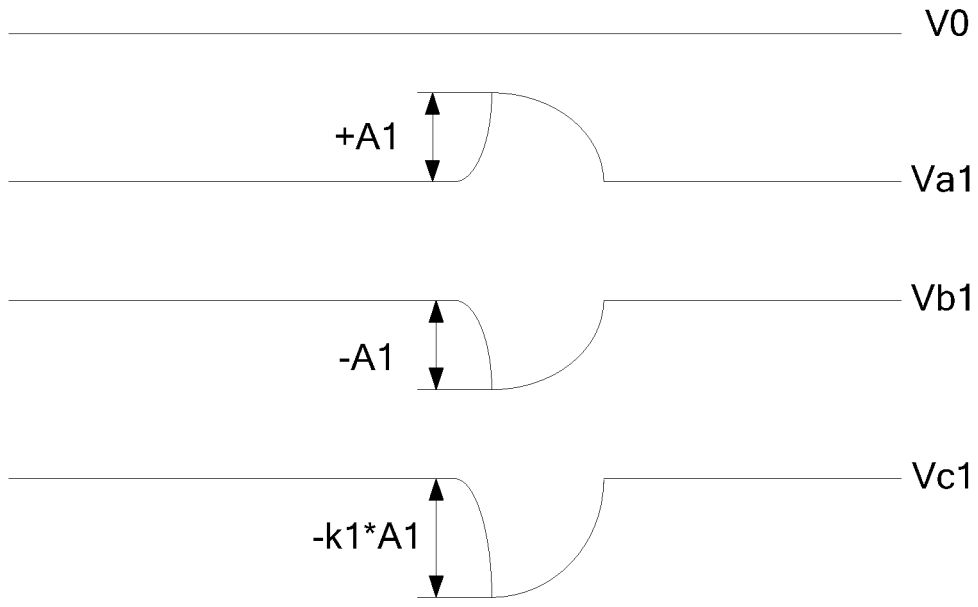
FIG. 2 is a waveform comparison diagram of a common voltage, a feedback signal thereof, a feedback signal after inversion and a compensation signal of a liquid crystal display panel provided by the embodiment of the present invention at a first feedback connection point.

Please refer to FIG. 2. It is assumed that the common voltage is V0, and the feedback signal obtained from the first feedback connection point 112 is Va1, and the feedback signal after inversion is Vb1, and the final compensation signal is Vc1. The feedback signal Va1 includes a positive pulse of amplitude A1, i.e., there is a positive interference pulse in the common voltage, and the amplitude of the positive interference pulse may be larger than the amplitude A1 of the positive pulse included in the feedback signal Va1. By implementing an inversion process to the feedback signal Va1, the obtained feedback signal Vb1 includes a negative pulse of amplitude A1. Furthermore, by implementing an amplifying process to the feedback signal Vb1, the compensation signal Vc1 is obtained. By adjusting the magnification k1 of the amplifier 133, the amplitude k1*A1 of the negative pulse included in the compensation signal Vc1 can be made exactly the same as the amplitude of the positive interference pulse in the common voltage, and finally, the compensation signal Vc1 is inputted to the common electrode line 115 so that the positive interference pulse in the common voltage is canceled by the negative pulse in the compensation signal Vc1, thereby achieving compensation to the common voltage.

In one embodiment, the array substrate 110 further comprises a second feedback connection point 114, and the second feedback connection point 114 is configured at one end of a common electrode line 115 located at one side of the array substrate 110 opposite to the driving circuit board 150, and the feedback signal processor 131 is connected to the second feedback connection point 114 via the first signal port 151 to obtain the feedback signals of the common voltages from the second feedback connection point 114.

Figure 3:
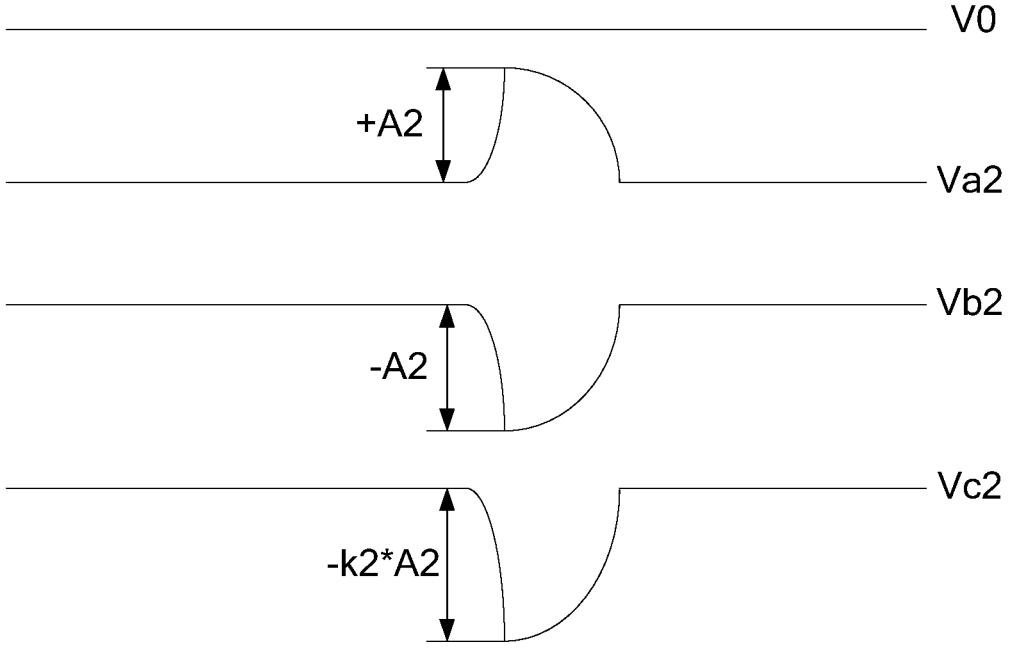
FIG. 3 is a waveform comparison diagram of a common voltage, a feedback signal thereof, a feedback signal after inversion and a compensation signal of a liquid crystal display panel provided by the embodiment of the present invention at a second feedback connection point.

Please refer to FIG. 3. It is assumed that the common voltage is V0, and the feedback signal obtained from the second feedback connection point 114 is Va2, and the feedback signal after inversion is Vb2, and the final compensation signal is Vc2. The feedback signal Va2 includes a positive pulse of amplitude A2, i.e., there is a positive interference pulse in the common voltage, and the amplitude of the positive interference pulse may be larger than the amplitude A2 of the positive pulse included in the feedback signal Va2. By implementing an inversion process to the feedback signal Va2, the obtained feedback signal Vb2 includes a negative pulse of amplitude A2. Furthermore, by implementing an amplifying process to the feedback signal Vb2, the compensation signal Vc2 is obtained. By adjusting the magnification k2 of the amplifier 133, the amplitude k2*A2 of the negative pulse included in the compensation signal Vc2 can be made exactly the same as the amplitude of the positive interference pulse in the common voltage, and finally, the compensation signal Vc2 is inputted to the common electrode line 115 so that the positive interference pulse in the common voltage is canceled by the negative pulse in the compensation signal Vc2, thereby achieving compensation to the common voltage.

IT will be appreciated that since the obtaining position of the feedback signal Va1 is different from the obtaining position of the feedback signal is Va2, the amplitude A1 of the positive pulse in the feedback signal Va1 may be different from the amplitude A2 of the positive pulse in the feedback signal Va2. In this embodiment, the amplitude A2 of the positive pulse in the feedback signal Va2 is larger than the amplitude A1 of the positive pulse in the feedback signal Va1. Therefore, as compensating the common voltages, the compensation signal Vc2 is larger than the compensation signal Vc1 in amplitude.

Figure 4:
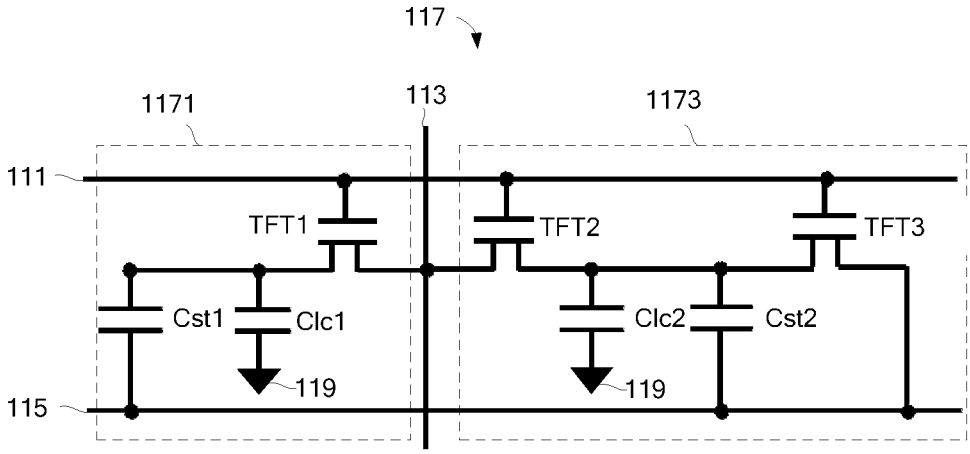
FIG. 4 is a structure diagram of a sub pixel unit of a liquid crystal display panel provided by the embodiment of the present invention.

Please refer to FIG. 4. One of the sub pixel units 117 comprises a main pixel region 1171 and a sub pixel region 1173, and the main pixel region 1171 and the sub pixel region 1173 each comprise a driving transistor TFT1 (TFT1) a storage capacitor Cst1 (Cst2) and a liquid crystal capacitor Clc1 (Clc2), and the common electrode lines 115 provide the common voltages to the storage capacitors Cst1, Cst2, and the sub pixel region 1173 further comprises a discharge transistor TFT3 to partially release charge on the liquid crystal capacitor Clc2 of the sub pixel region 1173 to one of the common electrode lines 115. In this embodiment, the liquid crystal display panel 100 is an 8 domains-3TFTs driving structure. In each of the sub pixel units 117, the charge on the liquid crystal capacitor Clc2 of the sub pixel region 1173 is released to the common electrode line 115 by the discharge transistor TFT3. Thus, the pixel voltages and the display brightnesses in the main pixel region 1171 and the sub pixel region 1173 can be different to achieve the effect of improving the color shift.

Specifically, the driving transistor, the storage capacitor and the liquid crystal capacitor of the main pixel region 1171 are a first transistor TFT1, a first storage capacitor Cst1 and a first liquid crystal capacitor Clc1, and a gate of the first transistor TFT1 is connected to one of the scan lines 111, and a drain of the first transistor TFT1 is connected to one of the data lines 113, and a source of the first transistor TFT1 is connected to one end of the first storage capacitor Cst1 and one end of the first liquid crystal capacitor Clc1, and the other end of the first storage capacitor Cst1 is connected to one of the common electrode lines 115, and the other end of the first liquid crystal capacitor Clc1 is connected to a common electrode 119. The common electrode 119 is located on a color filter (CF) substrate of the liquid crystal display panel.

The driving transistor, the storage capacitor and the liquid crystal capacitor of the sub pixel region 1173 are a second transistor TFT2, a second storage capacitor Cst2 and a second liquid crystal capacitor Clc2, and the sub pixel region further comprises a third resistor TFT3, and a gate of the second transistor TFT2 is connected to one of the scan lines 111, and a drain of the second transistor TFT2 is connected to one of the data lines 113, and a source of the second transistor TFT2 is connected to one end of the second storage capacitor Cst2 and one end of the second liquid crystal capacitor Clc2, and the other end of the second storage capacitor Cst2 is connected to one of the common electrode lines 115, and the other end of the second liquid crystal capacitor Clc2 is connected to a common electrode 119, and a gate of the third transistor TFT3 is connected to the one of the scan lines 111, and a drain of the third transistor TFT3 is connected to the source of the second transistor TFT2, and a source of the third transistor TFT3 is connected to the one of the common electrode lines 115.

It will be appreciated that as the scan signal on the scan line 111 is valid, the first transistor TFT1 and the second transistor TFT2 are activated, and the data voltage on the data line 113 is charged into the storage capacitors Cst1, Cst2 and the liquid crystal capacitors Clc1, Clc2. Meanwhile, the activation of the third transistor TFT3 will release a portion of charges stored in the liquid crystal capacitor Clc2 of the sub pixel region 1173 onto the common electrode line 115, thereby causing the common voltage to fluctuate. In this embodiment, by obtaining the feedback signals of the common voltages on the common voltage lines 115 and implementing the inversion process and the amplifying process to the feedback signals to obtain the corresponding compensation signals, and then to input the compensation signals to the common electrode lines 115 for realizing the compensation to the common voltages. It can effectively promote the stability of the common voltages and prevent the issues of crosstalk and image sticking of the liquid crystal display panel due to fluctuations in the common voltages to improve the quality of the liquid crystal display panel.

Figure 5:
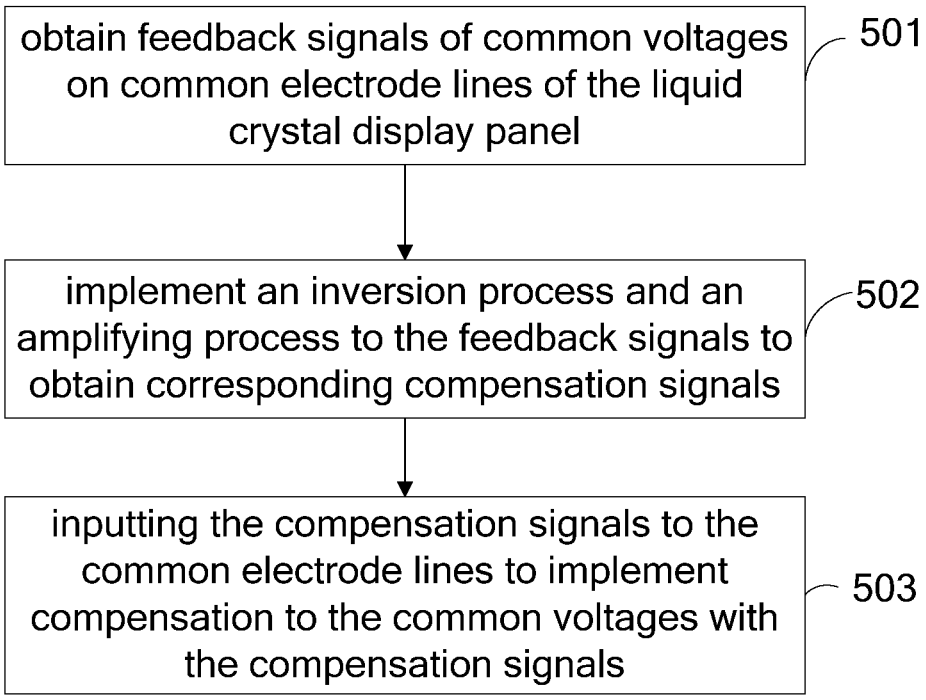
FIG. 5 is a flowchart diagram of a common voltage compensation method provided by the embodiment of the present invention.

Please refer to FIG. 5. In one embodiment of the present invention, provided is a common voltage compensation method of a liquid crystal display panel, comprising steps of:

step 501, obtain feedback signals of common voltages on common electrode lines of the liquid crystal display panel;

step 502, implement an inversion process and an amplifying process to the feedback signals to obtain corresponding compensation signals;

step 503, inputting the compensation signals to the common electrode lines to implement compensation to the common voltages with the compensation signals.

It can be understood that the specific functions and the achievement of the respective steps of the common voltage compensation method may also refer to the related descriptions in the embodiments shown in FIG. 1 to FIG. 4 and will not be described here.

Figure 6:
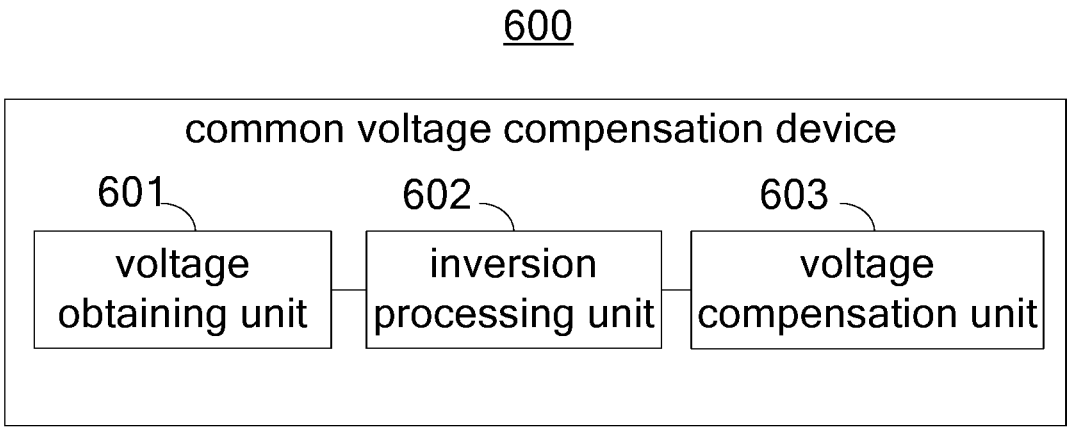
FIG. 6 is a structure diagram of a common voltage compensation device provided by the embodiment of the present invention.

Please refer to FIG. 6. In one embodiment of the present invention, provided is a common voltage compensation device 600 of a liquid crystal display panel, comprising:

a voltage obtaining unit 601, obtaining feedback signals of common voltages on common electrode lines of the liquid crystal display panel;

an inversion processing unit 602, implementing an inversion process and an amplifying process to the feedback signals to obtain corresponding compensation signals;

a voltage compensation unit 603, inputting the compensation signals to the common electrode lines to implement compensation to the common voltages with the compensation signals.

It can be understood that the specific functions and the achievement of the respective units of the common voltage compensation device 600 may also refer to the related descriptions in the embodiments shown in FIG. 1 to FIG. 4 and will not be described here.

By configuring the common voltage compensation circuit, the liquid crystal display panel obtains the feedback signals of the common voltages on the common voltage lines and implements the inversion process and the amplifying process to the feedback signals to obtain the corresponding compensation signals, and then to input the compensation signals to the common electrode lines for realizing the compensation to the common voltages, which can effectively promote the stability of the common voltages and prevent the issues of crosstalk and image sticking of the liquid crystal display panel due to fluctuations in the common voltages to improve the quality of the liquid crystal display panel.

Above are embodiments of the present invention, which does not limit the scope of the present invention. Any modifications, equivalent replacements or improvements within the spirit and principles of the embodiment described above should be covered by the protected scope of the invention.

What is claimed is:

1. A liquid crystal display panel, comprising: an array substrate and a common voltage compensation circuit, wherein the array substrate comprises a plurality of scan lines, which are separately arranged in parallel along a horizontal direction, a plurality of data lines, which are separately arranged in parallel along a vertical direction, a plurality of common electrode lines and a plurality of sub pixel units arranged in an array, and the scan lines provide driving voltages to the sub pixel units, and the data lines provide data voltages to the sub pixel units, and the common electrode lines provide common voltages to the sub pixel units, and the common voltage compensation circuit comprises a feedback signal processor, an amplifier and a common voltage adjusting circuit, and the feedback signal processor is connected to the common electrode lines to obtain feedback signals of the common voltages and to implement an inversion process to the feedback signals, and the amplifier is connected between the feedback signal processor and the common voltage adjusting circuit to implement an amplifying process to the feedback signals after inversion to obtain compensation signals, and the common voltage adjusting circuit inputs the compensation signals to the common electrode lines;

wherein the feedback signal processor of the common voltage compensation circuit is directly connected to an individual one of the plurality of common electrode lines and disconnected from remaining ones of the plurality of common electrode lines to directly receive an interference signal of the common voltage carried on the individual one of the plurality of common electrode lines in a manner of being independent of the remaining ones of the plurality of common electrode lines, the interference signal being taken as one of the feed signals of the common voltages and being inverted and amplified to form one of the compensation signals that is fed to the individual one of the plurality of common electrode lines.

2. The liquid crystal display panel according to claim 1, wherein the liquid crystal display panel further comprises a driving circuit board, and the driving circuit board is configured at one side of the array substrate and electrically connected to the array substrate via a first signal port and a second signal port, and the common voltage compensation circuit is configured on the driving circuit board to obtain the feedback signals of the common voltages via the first signal port and to provide the compensation signals to the common electrode lines via the second signal port.

3. The liquid crystal display panel according to claim 2, wherein the plurality of common electrode lines are arranged alternately in parallel with the plurality of scan lines, and are collectively connected to an output end of the common voltage adjusting circuit via the second signal port to obtain the common voltages from the common voltage adjusting circuit.

4. The liquid crystal display panel according to claim 3, wherein the array substrate further comprises a first feedback connection point, and the first feedback connection point is configured at one end of a common electrode line located at a middle position of the array substrate, and the feedback signal processor is connected to the first feedback connection point via the first signal port to obtain the feedback signals of the common voltages from the first feedback connection point.

5. The liquid crystal display panel according to claim 3, wherein the array substrate further comprises a second feedback connection point, and the second feedback connection point is configured at one end of a common electrode line located at one side of the array substrate opposite to the driving circuit board, and the feedback signal processor is connected to the second feedback connection point via the first signal port to obtain the feedback signals of the common voltages from the second feedback connection point.

6. The liquid crystal display panel according to claim 1, wherein one of the sub pixel units comprises a main pixel region and a sub pixel region, and the main pixel region and the sub pixel region each comprise a driving transistor, a storage capacitor and a liquid crystal capacitor, and the sub pixel region further comprises a discharge transistor to partially release charge on the liquid crystal capacitor of the sub pixel region to one of the common electrode lines.

7. The liquid crystal display panel according to claim 6, wherein the driving transistor, the storage capacitor and the liquid crystal capacitor of the main pixel region are a first transistor, a first storage capacitor and a first liquid crystal capacitor, and a gate of the first transistor is connected to one of the scan lines, and a drain of the first transistor is connected to one of the data lines, and a source of the first transistor is connected to one end of the first storage capacitor and one end of the first liquid crystal capacitor, and the other end of the first storage capacitor is connected to one of the common electrode lines, and the other end of the first liquid crystal capacitor is connected to a common electrode.

8. The liquid crystal display panel according to claim 6, wherein the driving transistor, the storage capacitor and the liquid crystal capacitor of the sub pixel region are a second transistor, a second storage capacitor and a second liquid crystal capacitor, and the sub pixel region further comprises a third resistor, and a gate of the second transistor is connected to one of the scan lines, and a drain of the second transistor is connected to one of the data lines, and a source of the second transistor is connected to one end of the second storage capacitor and one end of the second liquid crystal capacitor, and the other end of the second storage capacitor is connected to one of the common electrode lines, and the other end of the second liquid crystal capacitor is connected to a common electrode, and a gate of the third transistor is connected to the one of the scan lines, and a drain of the third transistor is connected to the source of the second transistor, and a source of the third transistor is connected to the one of the common electrode lines.

* * * * *